US005573605A

United States Patent [19]

Bendick et al.

[11] Patent Number: 5,573,605

[45] Date of Patent: Nov. 12, 1996

[54] HIGH-TEMPERATURE STEEL FOR BOILER MAKING

[75] Inventors: Walter Bendick, Duisburg; Klaus Haarmann, Ratingen; Ingo Von Hagen, Krefeld, all of Germany

[73] Assignee: Mannesmann Aktiengesellschaft, Dusseldorf, Germany

[21] Appl. No.: 399,857

[22] Filed: Mar. 7, 1995

[30] Foreign Application Priority Data

Mar. 9, 1994 [DE] Germany ..... 44 08 640.7
May 6, 1994 [DE] Germany ..... 44 16 794.6

[51] Int. Cl.[6] ..... C22C 38/22; C22C 38/24; C22C 38/28

[52] U.S. Cl. ..... 148/334

[58] Field of Search ..... 400/106, 110, 400/111; 148/334

[56] References Cited

U.S. PATENT DOCUMENTS 4,799,972 1/1989 Masuyama et al. ..... 148/334
5,211,909 5/1993 Iseda et al. ..... 420/106

FOREIGN PATENT DOCUMENTS 58-123860 7/1983 Japan ..... 420/106
60-17056 1/1984 Japan ..... 420/106

*Primary Examiner*—Deborah Yee
*Attorney, Agent, or Firm*—Cohen, Pontani, Lieberman, Pavane

[57] ABSTRACT

A high-temperature steel for boiler making having improved creep strength and low tendency to hardening in welded condition, having the following melt analysis (wt. %):

C 0.050 to 0.100%

Si 0.15 to 0.45%

Mn 0.30 to 0.70%

P ≦0.020%

S ≦0.010%

Al ≦0.020%

Cr 2.20 to 2.60%

Mo 0.90 to 1.10%

V 0.20 to 0.30%

Ti 0.05 to 0.10%

B 0.0015 to 0.0070%

N ≦0.01%

The balance of the steel is comprised of iron and ordinary impurities. The steel is annealed for a period of about 30 to about 60 minutes at about 980° C. to about 1040° C., thereupon cooled in air, and then tempered for at least one hour at about 730° C. to about 760° C.

1 Claim, No Drawings

HIGH-TEMPERATURE STEEL FOR BOILER MAKING

FIELD OF THE INVENTION

The present invention relates to a high-temperature steel for boiler making.

BACKGROUND OF THE INVENTION

One known high-temperature steel used in boiler making is 10 CrMo 9 10 steel, which corresponds approximately to grade T 22 of ASTM A 199, 200 and 213 as well as grade P 22 of ASTM A 335, and contains the following alloy elements (wt. %):

C 0.080 to 0.150%
Si ≦0.50%
Mn 0.40 to 0.70%
P ≦0.035%
S ≦0.035%
Cr 2.00 to 2.50%
Mo 0.90 to 1.20%

The high-temperature strength of this steel is sufficient for many uses but does not meet the higher demands for certain applications. For high stresses, high-alloy steels are frequently used, such as, for example, the high-temperature steel X 20 CrMo V 12 1, which contains 12% chromium. However, these steels are both expensive and difficult to work with.

A high strength, heat-resistant steel alloy is disclosed in European Patent 0 411 515 A1 which has the following alloy elements (wt. %):

C 0.030 to 0.120%
Si ≦1.0%
Mn 0.20 to 1.00%
P ≦0.030%
S ≦0.030%
Ni ≦0.8%
Cr 0.7 to 3.0%
Mo 0.30 to 0.70%
W 0.6 to 2.4%
V 0.05 to 0.35%
Nb 0.01 to 0.12%
N 0.10 to 0.50%

In this alloy, the proportions of W and Mo satisfy the following relationship:

$$0.8\% \leqq (\text{Mo } \% + \tfrac{1}{2}\text{W } \%) \leqq 1.5\%$$

The manufacture of such steel is considerably expensive due in particular to the requirement that the W is homogeneously distributed. Furthermore, due to the high resistance to deformation to different coatings, difficulties are encountered with respect to hot shaping, for instance, upon the rolling of seamless robes. There is thus a need for a high-temperature steel which has very high values of high-temperature strength but also can be produced at relatively little cost and can be readily processed further.

SUMMARY OF THE INVENTION

The object of the present invention is to produce a high-temperature boiler steel of substantially improved creep strength starting from 10 CrMo 9 10 steel. In contradistinction to the known high-strength martensitic steels, the steel of the present invention shows considerably less tendency to hardening in its welded state so that subsequent heat treatment is no longer necessary for thin-walled structural parts after welding.

This object is achieved in accordance with the present invention by a bainitic high-temperature steel having the following chemical composition (wt. %):

C 0.050 to 0.095%
Si 0.15 to 0.45%
Mn 0.30 to 0.70%
P ≦0.020%
S ≦0.010%
Al ≦0.020%
Cr 2.20 to 2.60%
Mo 0.90 to 1.10%
V 0.20 to 0.30%
Ti 0.05 to 0.10%
B 0.0015 to 0.0070%
N ≦0.01%

The balance of the steel is comprised of iron and ordinary impurities.

The steel is annealed for about 30 to about 60 minutes at about 980° C. to about 1040° C., is then cooled in air, and is finally tempered for at least about one hour at about 730° C. to about 760° C. The resulting steel is particularly suitable for use in the manufacture of seamless, as well as welded, steel tubes and plates. The products produced therefrom are used in heat-treated form. After welding, additional heat treatment of thin-walled components is unnecessary. The steel of the present invention is therefore particularly well-suited for the production of membrane walls.

Other objects and features of the present invention will become apparent from the following detailed description. It is to be understood, however, that the following detailed description is intended solely for purposes of illustration and not as a definition of the limits of the invention, for which reference should be made to the appended claims.

DETAILED DESCRIPTION OF THE PRESENTLY PREFERRED EMBODIMENTS

In accordance with the present invention, steel having the following chemical composition (wt. %) is formed:

C 0.050 to 0.095%
Si 0.15 to 0.45%
Mn 0.30 to 0.70%
P ≦0.020%
S ≦0.010%
Al ≦0.020%
Cr 2.20 to 2.60%
Mo 0.90 to 1.10%
V 0.20 to 0.30%
Ti 0.05 to 0.10%
B 0.0015 to 0.0070%
N ≦0.01%

The balance of the steel is comprised of iron and ordinary or typical impurities.

The steel is annealed for about 30 to about 60 minutes at about 980° C. to about 1040° C., is then cooled in air, and is finally tempered for at least about one hour at about 730° C. to about 760° C.

Surprisingly, it has been found that the known 10 CrMo 9 10 steel can be so modified by relatively simple measures so that the resulting steel has extremely good values of high-temperature strength and excellent suitability for further processing. To manufacture this alloy, first there must be a definitive decrease in the C content to less than about 0.100%. In addition, V, Ti, and B are to be added in the amounts indicated above. By reducing the content of C, there is a reduction in the strength values, such as tensile strength and elongation upon rupture; however, the tendency of the resulting steel to harden upon welding is reduced to such an extent that subsequent heat treatment is not necessary. By using V and Ti, carbonitrides, which are very stable to heat, are formed which promote the high temperature strength and creep strength. By using B, the through-hardening and the strength of the steel are improved; furthermore, B exerts a positive influence on the morphology and distribution of the carbonitrides. The interaction of C, V, Ti, and B to the quantity proportions indicated above leads to a completely surprising improvement in the high-temperature strength and creep strength as compared with known 10 CrMo 9 10 steel.

The benefits and effectiveness of the steel of the present invention will be explained in further detail on the basis of the following examples.

Two steels were prepared in accordance with the present invention. The composition of these steels with respect to the individual alloy components (the balance of the steel being comprised of iron and ordinary impurities) is indicated in the following table:

| Element | Steel 1 (wt. %) | Steel 2 (wt. %) |
|---|---|---|
| C | 0.080% | 0.073% |
| Si | 0.31% | 0.30% |
| Mn | 0.32% | 0.32% |
| P | 0.004% | 0.003% |
| S | 0.004% | 0.004% |
| Al | 0.013% | 0.008% |
| Cr | 2.53% | 2.55% |
| Mo | 1.08% | 1.01% |
| V | 0.26% | 0.25% |
| Ti | 0.08% | 0.076% |
| B | 0.0049% | 0.0063% |
| N | 0.0032% | 0.0017% |

After heat treatment by annealing at 1000° C. for 30 min, followed by cooling in air and further annealing at 750° C. for two hours, again followed by cooling in air, the following results were obtained at room temperature for the yield point ($R_{p\ 0.2}$), the tensile strength ($R_m$), the elongation at rupture ($A_5$), the necking at rupture (Z), and the notched bar impact work ($A_{V\ iso}$):

| | Steel 1 | Steel 2 |
|---|---|---|
| $R_{p0.2}$ (N/mm$^2$) | 615–629 | 595–601 |
| $R_m$ (N/mm$^2$) | 700–714 | 686–691 |
| $A_5$ (%) | 18 | 17–20 |
| Z (%) | 76–77 | 64–68 |
| $A_{Viso}$ (J) | 206–252 | 297–300 |
| | 100% shear fracture | 100% shear fracture |

These results clearly demonstrate the superiority of the steel of the present invention over conventional 10 CrMo 9 10 steel. Creep tests on specimens of the two steels of the above examples furthermore showed, after a test time of up to 63,000 hours, a surprisingly great improvement in the creep strength values. As shown in the following table, the values obtained, referring to periods of testing of 10,000 and 100,000 hours, are very substantially above the corresponding comparison values of conventional steel:

| Steel | 10 CrMo 9 10 | | | Invention | | |
|---|---|---|---|---|---|---|
| Test temperature (°C.) | 500 | 550 | 600 | 500 | 550 | 600 |
| σ B/10,000 hrs (N/mm$^2$) | 196 | 108 | 61 | 285 | 200 | 100 |
| σ B/100,000 hrs (N/mm$^2$) | 135 | 68 | 34 | 250* | 160* | 54* |

*Values extrapolated after 63,000 hours of testing

These results show that the steel of the present invention readily withstands comparison with the steel known from European Patent 0 411 515 A1 with respect to its creep strength. Its manufacture and processing costs are also clearly less.

Thus, while there have been shown and described and pointed out fundamental novel features of the invention as applied to preferred embodiments thereof, it will be understood that various omissions and substitutions and changes in the form and details of the invention described may be made by those skilled in the art without departing from the spirit of the invention. It is the intention, therefore, to be limited only as indicated by the scope of the claims appended hereto.

What is claimed is:

1. A high-temperature steel for boiler making consisting essentially of the following melt analysis (wt. %):

C 0.050 to 0.095%

Si 0.15 to 0.45%

Mn 0.30 to 0.70%

P ≦0.020%

S ≦0.010%

Al ≦0.020%

Cr 2.20 to 2.60%

Mo 0.90 to 1.10%

V 0.20 to 0.30%

Ti 0.05 to 0.10%

B 0.0015 to 0.0070%

N ≦0.01% the balance of which being comprised of iron and ordinary impurities the steel having been annealed for a period of 30 to 60 minutes at 980° C. to 1,040° C., thereupon cooled in oir, and then tempered for at least one hour at 730° C. to 760° C.

* * * * *